United States Patent [19]

Tannenbaum

[11] Patent Number: 4,971,276

[45] Date of Patent: Nov. 20, 1990

[54] FLASK CLAMP RETAINING MEANS AND METHOD

[75] Inventor: Myron Tannenbaum, East Brunswick, N.J.

[73] Assignee: New Brunswick Scientific Co., Inc., Edison, N.J.

[21] Appl. No.: 407,547

[22] Filed: Sep. 15, 1989

[51] Int. Cl.[5] ..... A47G 23/02

[52] U.S. Cl. ..... 248/154; 248/310; 248/313; 248/316.1

[58] Field of Search ..... 248/154, 160, 310, 313, 248/314, 315, 311.2, 316.1, 316.8, 316.7; 24/537

[56] References Cited

U.S. PATENT DOCUMENTS

| | | | |
|---|---|---|---|
| 1,068,627 | 7/1913 | Bythiner | 248/310 X |
| 2,583,680 | 1/1952 | Brennan | 24/537 X |
| 3,002,895 | 10/1961 | Freedman | 435/316 |
| 3,100,324 | 8/1963 | Tutino et al. | 24/537 X |
| 3,430,926 | 3/1969 | Freedman et al. | 366/212 |
| 3,601,372 | 8/1971 | Harmes | 366/219 |
| 3,830,474 | 8/1974 | Tannenbaum | 366/203 |
| 4,205,417 | 6/1980 | Mackal | 24/537 |

FOREIGN PATENT DOCUMENTS

| | | | |
|---|---|---|---|
| 0064816 | 6/1949 | Netherlands | 24/537 |

*Primary Examiner*—Ramon O. Ramirez
*Attorney, Agent, or Firm*—Robert S. Stoll

[57] ABSTRACT

Retaining means and method for use with multi-leaf spring clamps used to secure culture flasks, bottles or the like during imposed orbital, reciprocating or vibratory motion, a resilient encircling member which has adjustable engagement with the leaves of the spring clamp to prevent relative movement between the flask and the clamp. The resilient encircling member is provided with internal annular ribs or threads to engage the spring clamp leaves and may have a deformation-resistant annular flange for insertion and removal of the encircling member and for control of engagement pressure and holding power.

13 Claims, 3 Drawing Sheets

FLASK CLAMP RETAINING MEANS AND METHOD

BACKGROUND OF THE INVENTION

Agitation and mixing of chemical and biological fluids is accomplished with precision in laboratory and production facilities with shakers, examples which are shown in U.S. Pat. Nos. 3,002,895, 3,430,926, 3,601,372 and 3,830,474 sold commercially under the name Gyrotory®by New Brunswick Scientific Co., Inc. of Edison, N.J. Such shakers are adapted to carry a variety of containers such as glass flasks of the Erlenmeyer type and test tubes, frequently in quantity, on a platform which is motor-driven through a drive geometry capable of high speed and high eccentric forces to obtain the desired mixing or agitation over a specified period, which may range from minutes to days.

The flasks are commonly held on the shaker or moving platform by a multi-leaved or multi-splined spring clip which has outwardly flared upper edges to allow insertion and removal of the flask. The spring tension of the clip, which theoretically can be sufficiently high to hold the flask during shaking, as a practical matter must be sufficiently low to permit insertion and removal of the flask. As the design envelope for shaker speeds and eccentric forces increase, this practical limitation on spring tension has begun to manifest itself in the form of flasks vibrating in their spring clips until some failure is reached. Failure may run from non-conformity with shaking requirements (uniformity, no air bubbles, etc.) to catastrophic breakage of the flasks. In cases of microbial cultures, uniform cell growth may depend on flask stability during agitation. Flasks which are not firmly held may have significantly changed agitation patterns and unacceptable oxygen transfer rates. In addition, flasks which are not firmly held may be agitated at differing rates which affects accurate repeatability of agitation runs.

Prior devices for releasably securing flasks include a coil spring with a closure for opening and closing the coil spring around the splines of the clip. Such devices are relatively expensive to make, hard to clean (a particular disadvantage in sterile or controlled environments) and difficult to manipulate in close quarters resulting in improperly secured flasks.

SUMMARY OF THE INVENTION

The present invention provides means for adjustably or selectively increasing the holding power of shaker spring clips after a flask is inserted and for reducing the holding power of the spring clip when the flask is to be inserted or removed from the spring clip.

The present invention comprises a resilient encircling member, adapted to engage around the splines of existing spring clamps and resiliently increase spline pressure against the wall of a flask to hold the flask more securely in place during imposed vibratory or shaking motion. The encircling member is flared at its lower edge to slip over the outwardly turned spline ends. The encircling member has inner non-slip means to prevent the encircling member from backing off the spring during the shaking. The encircling member may also have deformation- or stretch-resistant means at its upper edge, such as an annular flange, which prevents the upper region of the member from stretching as much as the lower region so that the encircling member tightens around the spring the more it is pushed on.

The encircling member of the invention, preferably a molded single-piece polyproplyene or similar material unit having no latches or moving parts, is economical to make, simple to use and is easily cleaned or autoclaved. Polyethylene is another desirable material from which the encircling member may be molded. It is within the contemplation of the invention that encircling member may be made of a flexible metal band which deforms rather than stretches when engaged around the spring clip.

DESCRIPTION OF THE PREFERRED EMBODIMENT

Figure 1:
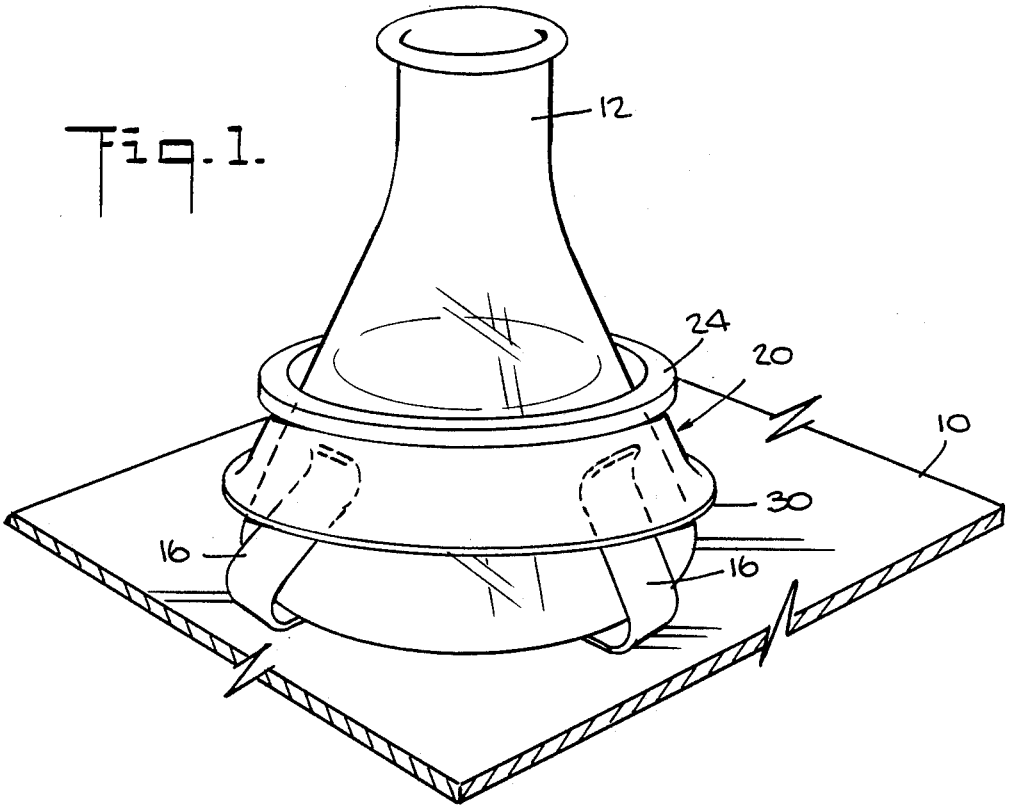
FIG. 1 is a perspective view of a flask held on a portion of a platform of a shaker by a multi-splined spring clip, with the resilient encircling member in position around the spline ends, the latter shown in phantom.
Figure 2:
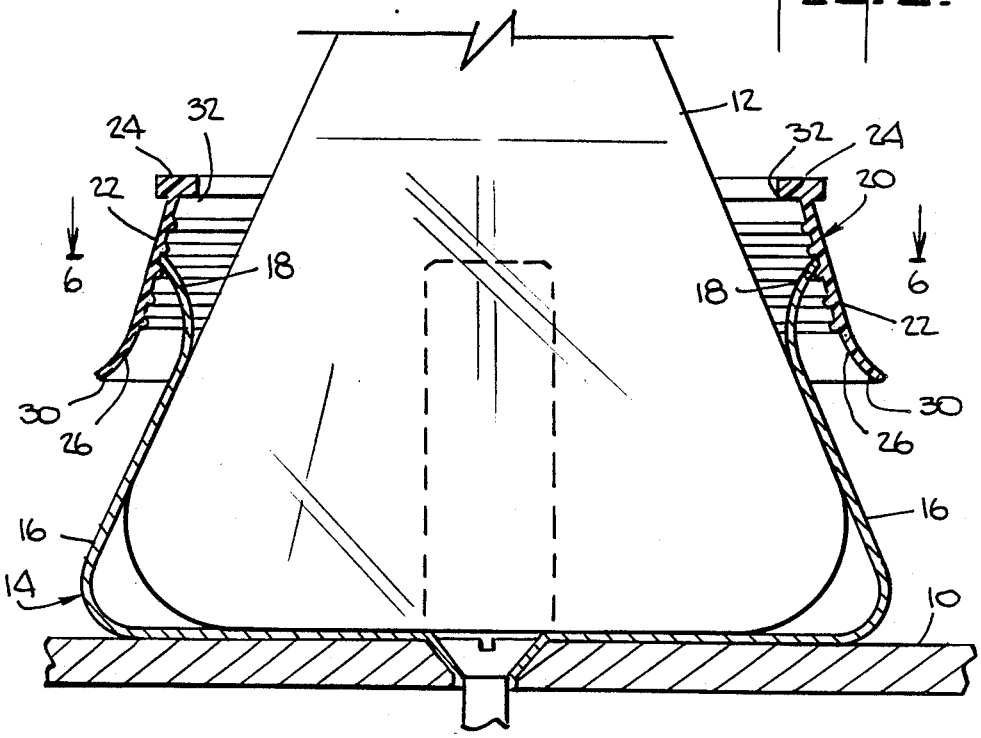
FIG. 2 is a vertical cross-sectional view of the assembly of FIG. 1.

Biological shaking machines as used in research, development and production of pharmaceuticals, biochemicals and agricultural products come in a variety of sizes, capacities and speeds, and may be open or enclosed in environmental chambers such as incubators. Such shaking machines conventionally have a platform 10 upon which are mounted the retorts, test tubes or flasks 12 containing the medium to be agitated. A spring clip 14 having multiple fingers or splines 16 is fastened upstanding from platform 10. Splines 16 removably hold a flask 12 to platform 10. Each spline 16 has an outwardly turned upper end 18 to allow entry and removal of flask 12.

Figure 5:
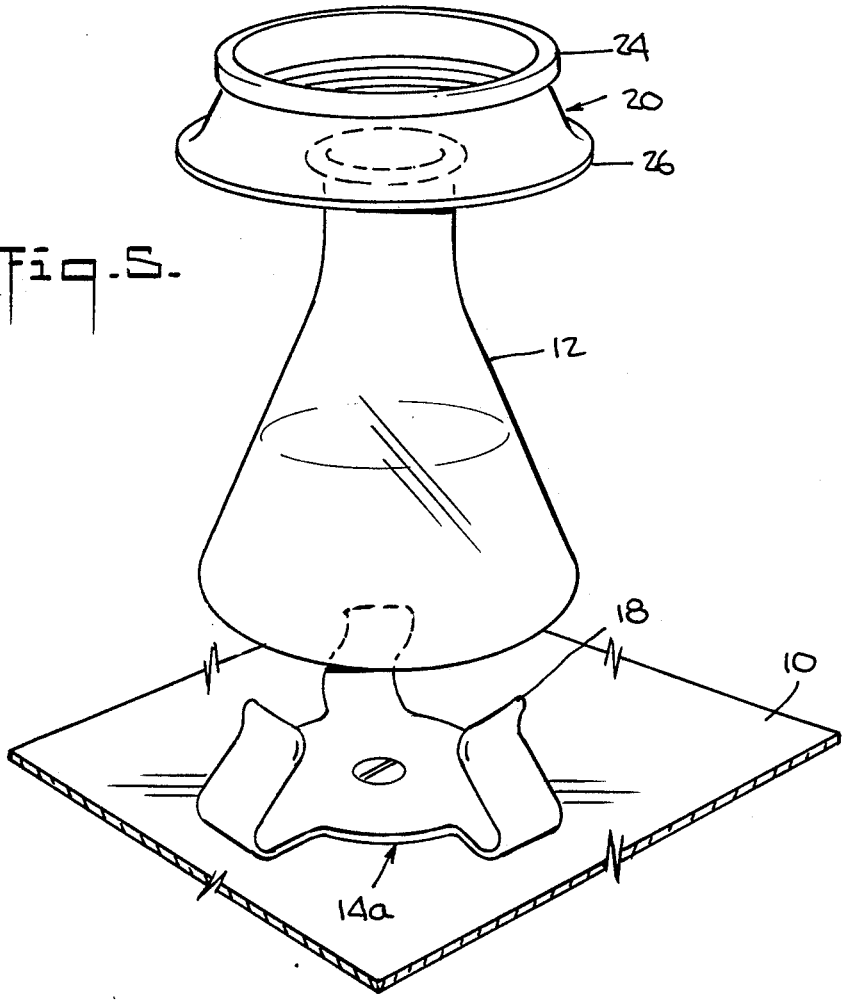
FIG. 5 is an exploded view showing, from top to bottom, the resilient encircling member, the flask, a three-spline spring clip and the shaker platform.
Figure 6:
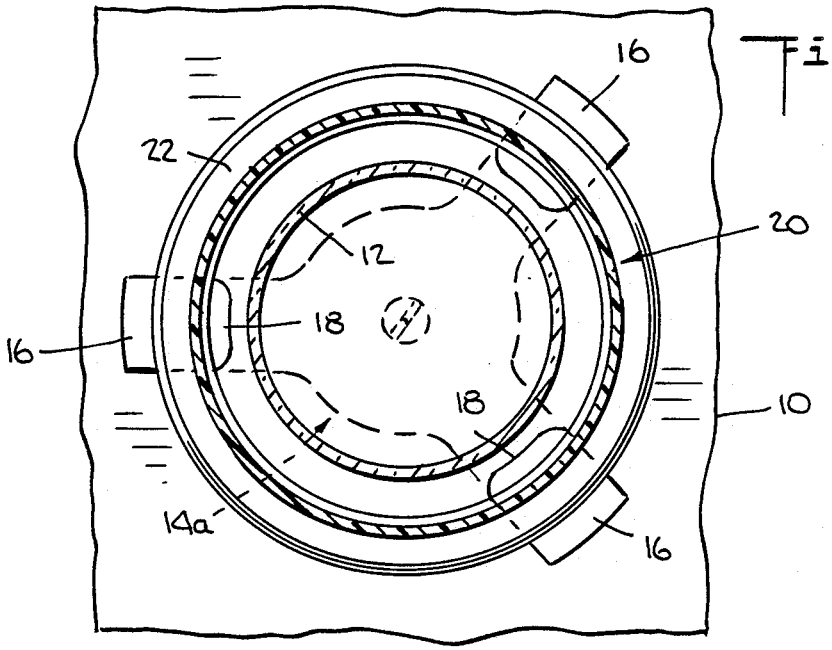
FIG. 6 is a cross-sectional view as across line 6—6 of FIG. 2, but showing the three-spline spring clip of FIG. 5.

A preferred form of spring clip 14a, having three splines 16, is shown in FIGS. 5 and 6. The remaining drawing figures show a spring clip with four splines.

Spring clip 14 including its splines 16 is generally formed from spring steel. The spring tension force is predetermined by such factors as alloy and temper and is a non-adjustable compromise between being high enough to hold the flask in place but not so high as to prevent easy insertion and removal of the flask without breaking the glass or spilling its contents. In cases where flasks are mounted close to each other on platform 10, and particularly when they are in an environmental chamber such as an incubator, there is generally little or no maneuvering room and the spring tension cannot be too high or there will be difficulty in inserting and removing the flasks. This practical limit on spring tension also limits the speeds at which the shaker can operate before the flasks begin to wobble in the spring clips, eventually falling out or breaking.

The resilient encircling ring means 20 of the present invention preferably comprises a substantially cylindrical or frustoconical first portion or central section 22, a second portion comprising an outward flare 26 at its lower edge and a third portion comprising an annular flange 24 at its upper edge. As used herein, upper and lower are as shown in the drawing, with lower being toward the bottom of flask 12 and platform 10 and upper being toward the top of flask 12 and away from platform 10; outwardly means radially away from flask 12 and inwardly means radially toward flask 12. As also used herein, resilient means elastic in the preferred embodiment and also means flexible.

The inner surface of central section 22 is provided with non-slip means, such as a plurality of annular ribs 28 or helical threads. With either ribs or threads a press-on and pull-off action is possible; a screw-on, screw-off action is additionally available if helical threads are provided.

Flare 26 joins central section 22 in a smooth curve on the inner surface of ring 20 so that the ring can easily slip over the outwardly turned ends 18 of splines 16. The outwardly turned ends 18 define a circle the diameter of which is fixed when a flask is being held and, as so fixed, will be referred to as the spring tip diameter or the spline diameter.

Figure 3:
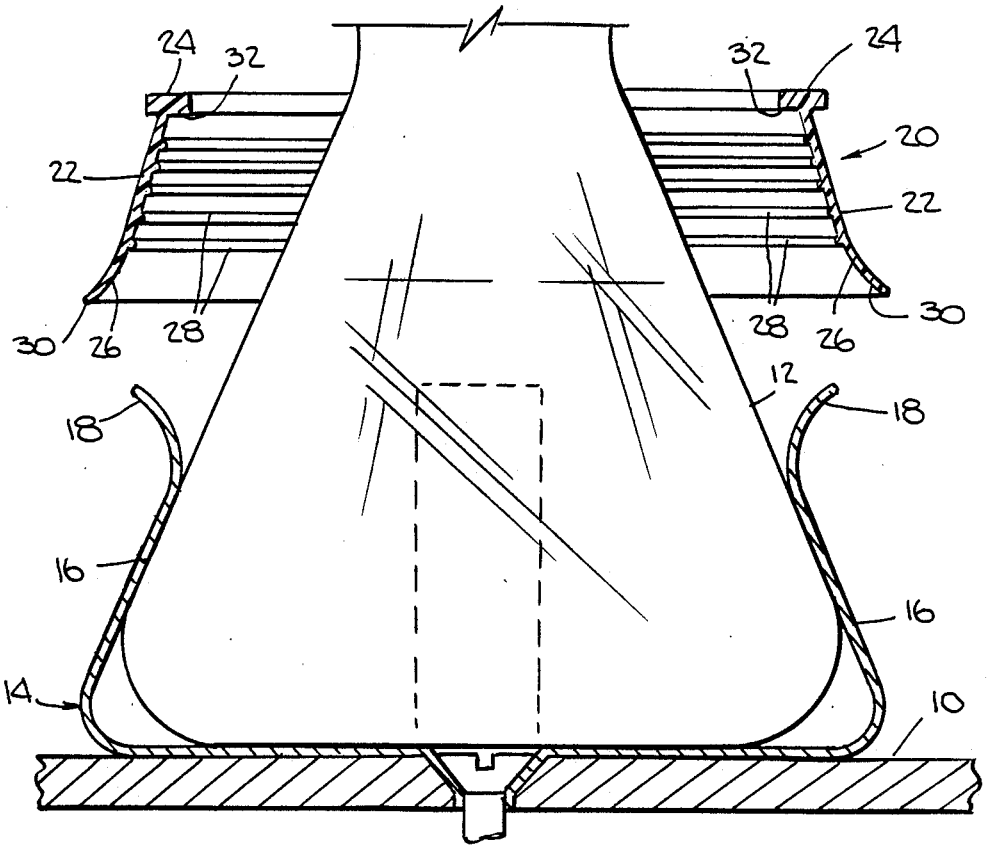
FIG. 3 is a view similar to that of FIG. 2, showing the resilient encircling member above the spring clip.
Figure 4:
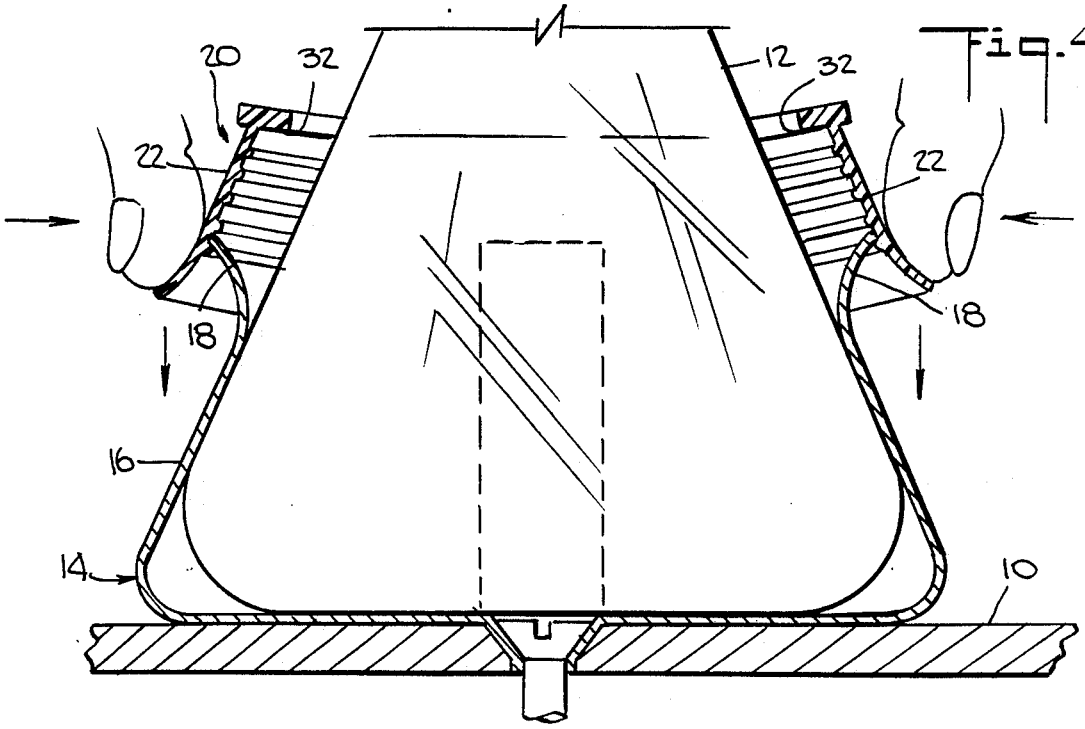
FIG. 4 is a view similar to that of FIG. 2, showing the resilient encircling member being positioned on the splines of the spring clip.

When in its relaxed, non-stretched or non-deformed condition, as in FIGS. 3 and 5, the inner surface of flare 26 has a diameter at its bottom or leading edge 30, referred to as the flare end diameter, which is larger than the spring tip diameter. The flare end diameter tapers into the inner diameter of central section 22, referred to as the central diameter. It is an important aspect of the invention that at least a portion of the central diameter is less than the spring tip diameter. If central section 22 is cylindrical, it has only one central diameter, less than the spring tip diameter. If central section 22 is frustoconical, or defines any curve of rotation, then the diameter of at least a portion of that section is less than the spring tip diameter. In this manner, when elastic ring 20 is pushed over spline ends 18, the ring has to stretch, expand or deform as its inner diameter becomes smaller from the flare end to the central section. When so stretched, the elastomeric properties of ring 20 hold splines 16 more tightly against flask 12, thereby holding the flask in place for more vigorous shaking than would be possible with spring clip 14 alone. If ring 20 is made of a flexible band of metal, it deforms to tightly fit over the splines providing the additional holding power.

Spline tips 18 engage annular ribs 28 to prevent ring 20 from slipping off. If ribs 28 define helical threads, ring 20 may be screw-tightened onto spring clip 14 by normal clockwise rotation, and removed by counter-clockwise rotation. Otherwise, ring 20 is pulled off manually, with the external edge of annular flange 24 forming a finger-hold which, when pulled, tends to twist or expand central section 22 outwardly and release ribs 28 from spline tips 18.

Annular flange 24 may extend radially inwardly to form a lip 32 which acts as stop means against spline tips 18 to prevent ring 20 from being pushed too far down, past the spline tips. Annular flange 24 also tends to resist stretching more than does flare 26. Ring 20 therefore has more holding force closer to flange 24 than it does at its lower end closer to flare 26. This vertical or axial elastic force gradient represents greater holding power the closer flange 24 gets to spline tips 18. Thus, the more ring 20 is pushed onto spring clip 14, the better is flask 12 held in place.

Ring 20 may be made of any resilient or flexible material suitable to the environment in which the shaking machine is used. Polyproplyene is a preferred material due to its ease of being molded, its ability to be provided in various colors for color coding sizes, its low cost and its easy cleanability.

Since ring 20 provides considerable additional holding power to spring clamp 14, in many applications it may no longer be necessary to make the spring clamps out of tempered spring or stainless steel. Plastic spring clamps may be used which avoids the need to use stainless steel or coated steel to avoid corrosion or scratching. Breakage of glass or plastic flasks is reduced because less force is necessary to insert them into and remove them from the spring clamp.

While the foregoing is illustrative of a preferred embodiment, variations and modifications may be had within the invention. For example, if square cross-section bottles are used, ring 20 may either be circular or square.

What is claimed is:

1. Clamp retaining means, comprising (a) clamp means, said clamp means comprising multiple splines adapted to hold an article, said splines defining at least one spline diameter, (b) resilient ring means, said elastic ring means comprising means adapted to elastically engage said splines against said article, said resilient ring means further comprising a first portion which at least at one location defines an inner diameter which is less than said spline diameter and a second portion joined to said first portion which at least at one location defines an inner diameter which is greater than said spline diameter.

2. Clamp retaining means in accordance with claim 1, wherein said second portion of said resilient ring means comprises an outwardly flared portion adapted to fit over said splines, at least one portion of said outwardly flared portion having an inner diameter which is greater than said spline diameter.

3. Clamp retaining means in accordance with claim 1, wherein said resilient ring means additionally comprises a third portion, said third portion being joined to said first Portion opposite said second portion, said third portion comprising resist means adapted to resist elastic deformation more than said first portion resists deformation.

4. Clamp retaining means in accordance with claim 1, wherein said resilient ring means additionally comprises a third portion, said third portion being joined to said second portion opposite said first portion, said third portion comprising resist means adapted to resist elastic deformation more than said second portion resists deformation.

5. Clamp retaining means in accordance with claim 1, wherein said first portion additionally comprises non-slip means on its surface which engages said splines.

6. Clamp retaining means in accordance with claim 3 or claim 4, wherein said third portion comprises flange means, said flange means extending inwardly of said first portion to form stop means when in engagement with said splines.

7. Clamp retaining means in accordance with claim 3 or claim 4, wherein said third portion comprises flange means, said flange means extending outwardly of said first portion to form at least one holding member adapted to be held to disengage said elastic ring means from said splines.

8. Clamp retaining means in accordance with claim 3 or claim 4, wherein said resist means comprises enlarged means formed integrally with said third portion, said enlarged means extending inwardly of said first portion to form stop means when in engagement with said splines and extending outwardly of said first portion to form at least one holding member adapted to be held to disengage said elastic ring means from said splines.

9. Clamp retaining means in accordance with claim 8, wherein said resilient ring means is formed of polyproplyene.

10. Clamp retaining means in accordance with claim 8, wherein said resilient ring means is formed of polyethylene.

11. Clamp retaining means in accordance with claim 8, wherein said resilient ring means is formed of metal.

12. Clamp retaining method, comprising the steps of (a) inserting an article into a multi-fingered clamp, (b) expanding the lower portion of a resilient ring to fit over said multi-fingered clamp, (c) restraining the upper portion of said resilient ring from expanding to a diameter which is the same as the diameter of a circle defined by said multi-fingered clamp, (d) whereby said elastic ring tightly engages said multi-fingered clamp against said article.

13. Clamp retaining method in accordance with claim 12, additionally comprising the steps of removing said resilient ring from said multi-fingered clamp by causing the lower portion of said ring to twist outwardly to disengage from said clamp.

* * * * *